United States Patent [19]

Menahem

[11] 4,114,963

[45] Sep. 19, 1978

[54] SUSPENDED FILES

[75] Inventor: Salomon Menahem, Hadera-Karkur, Israel

[73] Assignee: Superfile, Ltd., Hadera-Karkur, Israel

[21] Appl. No.: 780,182

[22] Filed: Mar. 22, 1977

[30] Foreign Application Priority Data

Apr. 5, 1976 [IL] Israel ..... 49347
Dec. 14, 1976 [IL] Israel ..... 51101

[51] Int. Cl.[2] ..... A47B 63/00
[52] U.S. Cl. ..... 312/184; 402/5
[58] Field of Search ..... 312/184, 183; 402/4, 402/38, 5; 211/46

[56] References Cited

U.S. PATENT DOCUMENTS

| | | | |
|---|---|---|---|
| 2,252,402 | 8/1941 | Kern | 312/184 |
| 3,865,445 | 2/1975 | Dean et al. | 312/184 |

FOREIGN PATENT DOCUMENTS

| | | | |
|---|---|---|---|
| 1,039,182 | 4/1902 | France | 312/184 |
| 1,263,690 | 4/1966 | Fed. Rep. of Germany | 312/184 |
| 1,088,024 | 11/1955 | Fed. Rep. of Germany | 312/184 |
| 819,682 | 4/1951 | Fed. Rep. of Germany | 312/184 |
| 1,137,963 | 6/1957 | Fed. Rep. of Germany | 312/184 |

*Primary Examiner*—Mervin Stein
*Assistant Examiner*—Victor N. Sakran
*Attorney, Agent, or Firm*—Haseltine, Lake, & Waters

[57] ABSTRACT

The present invention concerns suspended files of the kind in which the two open longitudinal edges of the files are held in reinforcing sheet-metal channels and extend beyond the transverse ends of the file where they are cut on their underside to form integral suspension elements by which said files are suspended in vertical position from rods or other suspension means one behind the other in a drawer or filing cabinet or the like.

2 Claims, 7 Drawing Figures

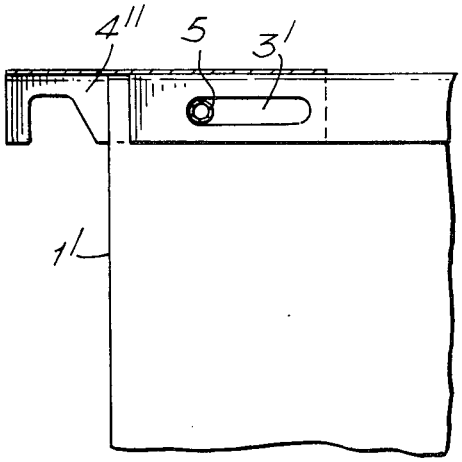
FIG. 4
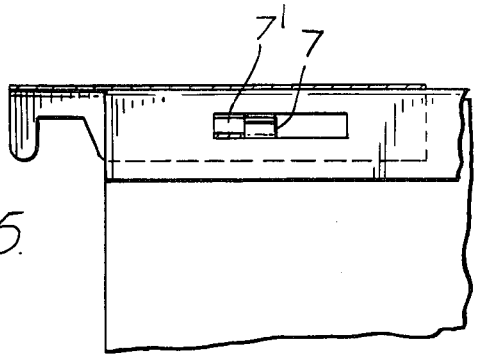
FIG. 5
FIG. 6
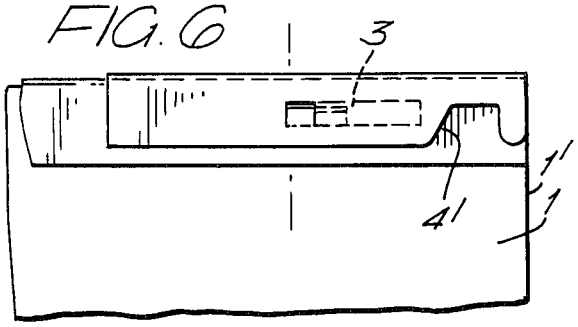
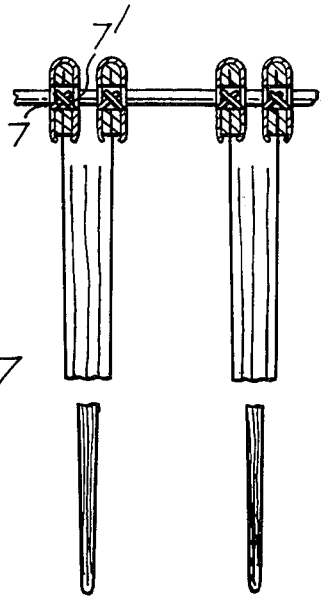
FIG. 7

SUSPENDED FILES

The main drawback of files with this kind of suspension element is the fact that said extensions often get damaged, are apt to tear clothing or to damage other files and books or the like material which are used in the course of office work.

It is the object of the present invention to provide a file whereby these drawbacks are overcome.

The invention consists in a suspended file wherein the suspension elements are made as parts separate from the reinforcing channel of the longitudinal edges of the file, being longitudinally movable relative thereto and adapted to be extended from or superposed on said file.

In one embodiment of the invention said channel is provided near both ends with throughgoing axially extending elongated slots, the file being provided with a registering slot, the suspension elements being constituted by short channels and each having a rivot fastened therethrough which extends through said slots.

In another embodiment of the invention the suspension elements which are constituted by short channels are provided with a protrusion in both legs of said channel, said protrusions extending inwards into the slot and being adjacent each other when seen in plan.

The invention is illustrated, by way of example only, in the accompanying drawings in which:

FIG. 4 is a corner of a file showing a variation of said embodiment of the invention;

FIG. 5 is a corner of a file showing a second embodiment of the invention in the extended position;

FIG. 6 is a view similar to FIG. 5 showing the extension element withdrawn;

FIG. 7 is an end view of the file taken on line VII—VII of FIG. 6.

Referring to FIGS. 1–4, a file 1 is provided at both longitudinal edges with a channel 2 of sheet metal, plastics or the like, in which said edges of the file are tightly held as known per se. Near both transverse edges 1' of file 1, axially extending elongated slots 3 are provided on both legs of said channel, registering slots extending also through the file itself.

Figure 1:
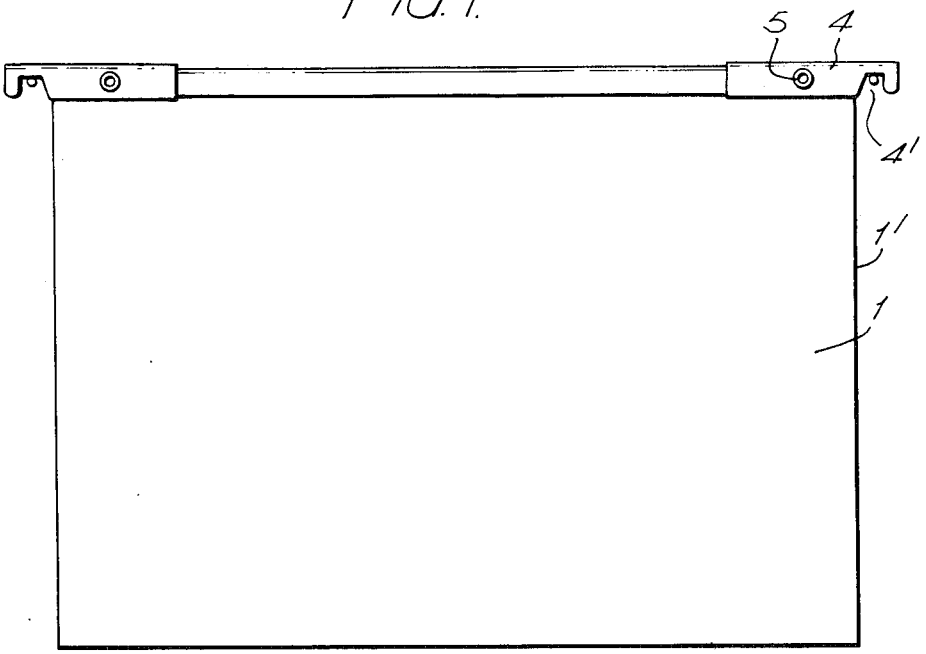
FIG. 1 is a plan view of part of a file according to the invention with one embodiment of the suspension element in the extended position.
Figure 2:
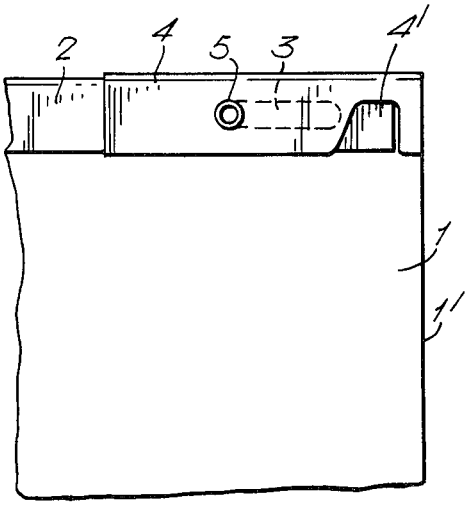
FIG. 2 is a corner of a file with the said suspension element withdrawn.
Figure 3:
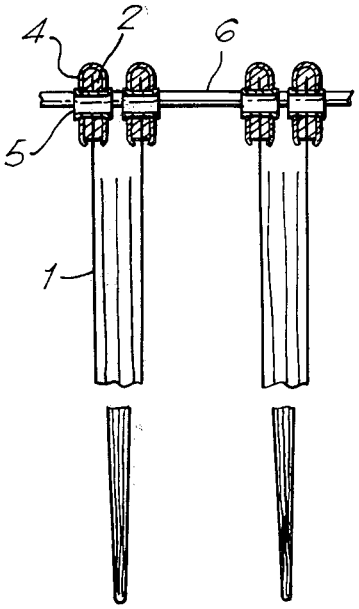
FIG. 3 is an end view of the depending files.

The suspension element 4 which at its end is in the shape of a hook owing to a cutout 4' made on its underside, is constituted by a channel which rides on channel 2 and has a rivet 5 extending from one leg to the other and through slots 3 in the channel 2 and the file 1, the movement of said rivet and thus element 4 being limited by said slot 3. In the position of FIG. 2, the suspension element 4 projects from the transverse edges of the file so that the latter can be suspended from a rod 6 of a drawer or file cabinet as shown in FIG. 3 and in its other position said element 4 is withdrawn on top of channel 2.

In FIG. 4 the suspension element 4' is provided with registering elongated slots 3' and a rivet 5 is fixed through the legs of channel 2 and through file 1 and extends therefrom on either side into holes 3' of elements 4'.

In the embodiment of the invention shown in FIGS. 5–7, parts similar to those of FIGS. 1–4 have been indicated by the same reference numeral.

According to this embodiment, the channel 2 of sheet metal is provided in both legs with axially extending elongated slots 3 near both transverse 1' of the file 1 into which slots, lugs 7,7' extend. These lugs are adjacent each other when seen in plan and are formed by U-shaped cuts made in the legs of the channel and are bent inwards. While in the example shown the lugs 7,7' are integral with the legs of the channel at the side parallel to the bottom edge of the latter, these lugs may be integral with the legs near the top edges or they may be oriented either towards the left or the right of said channels.

If desired, the lugs may be replaced by swaged beads or the like similar protrusions.

While in the above description only two embodiments have been shown, it is to be understood that the present invention is not limited thereto and many variations are possible without departing from the scope thereof. Thus, for example, the suspension elements may be made of wire, one end being shaped as a hood, while the other is shaped into an elongated eyelet, which slides on a bolt or pin having a button head provided at each end of each reinforcing channel.

Or, as a further example, near both ends of the reinforcing channel, the material of the channel is swaged outwardly between one or two pairs of slits extending perpendicular to the extension of the channel, a suspension element in the form of a strip of metal, plastics or the like being slidable within said slits.

Or, as still a further example, one leg of said channel may be bent, swaged or otherwise formed at both ends in such a manner that a depressed groove is provided on its inside, in which a suspension element is slidable.

I claim:

1. A suspended file comprising: a file with longitudinal edges; reinforcing channels for the longitudinal edges of said file; suspension elements having separate parts from said reinforcing elements and being longitudinally movable relative to said reinforcing channels; said suspension elements comprising short channels mounted on top of said reinforcing channels; said reinforcing channels having through-going longitudinally extending elongated slots; said files having a registering slot for alignment with said elongated slots; said suspension elements having means extending into said slot to limit sliding movement. , said suspension elements having hook-shaped ends with a cutout on the underside thereof, said suspension element comprising channel means riding on top of said reinforcing channels and having a rivet extending through said slot, the movement of said rivet and said suspension elements being limited by said slot, said suspension elements projecting from transverse edges of said file.

2. A suspended file comprising: a file with longitudinal edges: reinforcing channels for the longitudinal edges of said file; suspension elements having separate parts from said reinforcing elements and being longitudinally movable relative to said reinforcing channels; said suspension elements comprising short channels mounted on top of said reinforcing channels; said reinforcing channels having through-going longitudinally extending elongated slots; said files having a registering slot for alignment with said elongated slots; said suspension elements having means extending into said slots to limit sliding movement, said suspension elements having hookshaped ends with a cutout on the underside thereof, said means extending into said slots to limit sliding movement comprising lugs formed by U-shaped cuts in two legs of said suspension element, said lugs being bent inward and being adjacently located relative to each other.

* * * * *